United States Patent [19]

Katzer

[11] 3,940,185

[45] Feb. 24, 1976

[54] CENTERING DEVICE FOR RAIL BRAKE MAGNETS ON VEHICLES

[75] Inventor: Ernst Katzer, Munich, Germany

[73] Assignee: Knorr-Bremse GmbH, Munich, Germany

[22] Filed: Apr. 2, 1975

[21] Appl. No.: 564,287

[30] Foreign Application Priority Data

Apr. 2, 1974 Germany ..... 2415858

[52] U.S. Cl. ..... 308/3 R; 105/77; 188/165; 188/206 R; 308/4 R; 308/32

[51] Int. Cl.[2] ..... F16C 29/02; F16D 65/34

[58] Field of Search ..... 188/48, 165, 206 R; 308/3 R, 4 R, 15, 31, 32; 105/76, 77, 78

[56] References Cited

UNITED STATES PATENTS 768,357 8/1904 Corey ..... 188/165

2,780,317 2/1957 Bachman et al. ..... 188/206 R X

FOREIGN PATENTS OR APPLICATIONS 262,901 2/1913 Germany ..... 308/31

1,903,315 1/1969 Germany ..... 188/165

*Primary Examiner*—George E. A. Halvosa

*Attorney, Agent, or Firm*—Edmund M. Jaskiewicz

[57] ABSTRACT

A device for centering a rail brake magnet comprises a centering element on the vehicle structure and having a centering bore with a conical surface around the bore. The magnet is provided with a rotatably adjustable eccentric sleeve within which is rotatably positioned a centering pin having a conical surface engageable with the conical surface around the centering bore. A portion of the pin has an eccentric peripheral portion disposed within the eccentric sleeve to provide for adjustment of the centering pin with respect to the magnet so that the adjusted position is secured by means of a screw coupling.

12 Claims, 4 Drawing Figures

CENTERING DEVICE FOR RAIL BRAKE MAGNETS ON VEHICLES

Figure 1A:
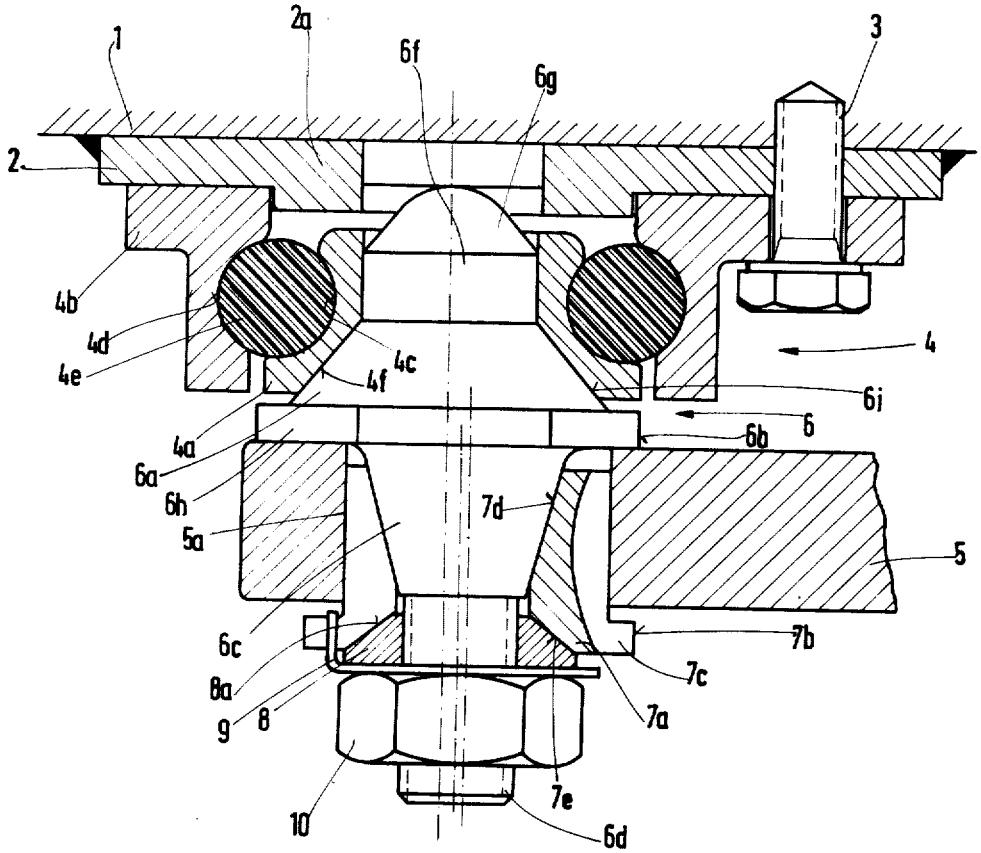

The present invention relates to a device for centering a rail brake magnet mounted upon a vehicle structure, more particularly, to such a centering device which can be adjusted to facilitate centering of the rail brake magnet when it is raised to its inoperative position.

Vehicles, particularly railway vehicles, have been equipped with rail brake magnets which are displaceable between a lower braking position and an upper inoperative position by means of a suitable actuation device mounted between the magnet and the vehicle structure. Interengaging conical surfaces have been generally provided on the rail brake magnet and the vehicle structure for locating the magnet with respect to the vehicle structure when the magnet is raised to its inoperative position.

When the magnet is raised to its inoperative position, various vibrations and forces acting on the mass of the magnet during travel of the vehicle produce transverse forces which result in an undesirable swinging of the magnet and possible abutting of the magnet against other components of the vehicle. These vibratory forces must be eliminated as much as possible without undue play between the components which support the rail brake magnet from the vehicle structure.

There is also the likelihood that the magnet because of the clearance between the parts is deflected toward one side or the other when in its lowered working position. It is desired that the cooperating engaging structures on the magnet and the vehicle structure be brought into proper abutting relationship when the magnet is raised into its inoperative position and that at the same time the magnet be properly centered so that the magnet is retained in its raised position with a minimum of wear between the abutting parts.

The German printed specification DT-AS 1,903,315 disclosed a structure intended to prevent the swinging of a rail brake magnet when it is in its raised inoperative position. The magnet has a stop member which transmits upwardly directed forces to portions of the vehicle structure when the magnet is raised into its inoperative position. This stop has conical surfaces which engage corresponding conical surfaces on the frame of the vehicle. The conical shape of the cooperating annular surfaces is intended to prevent swinging of the raised brake magnet in any direction but has the disadvantage of requiring a precise and secure centering of the abutting surfaces in all directions.

The German Gebraunchsmuster 7 326 669 discloses a rail brake magnet suspension structure of the general type described above wherein a centering pin mounted on either the vehicle structure or the magnet is received within a centering bore of a guide element mounted on the other of the vehicle structure end magnet. The centering pin has a conical end top surface followed by a cylindrical portion whose diameter is approximately the diameter of the centering bore and then tapers outwardly to form a conical portion which is engageable with a conical surface surrounding the centering bore. Here also satisfactory operation of the centering device requires precise and stable conditions for proper centering.

In order to provide for adjustment of the components to be centered it has been known to provide for a horizontal displacement of the centering bore on the vehicle structure until the centering bores are precisely aligned with the centering pin. The centering bore is formed in a flange or plate which is attached to the underside of the vehicle by means of bolts. The holes in the plate through which the bolts pass are provided with sufficient play so as to enable the plate to be laterally displaced and thereby bring about a centering with respect to the centering pin on the brake magnet.

This type of adjustment is not satisfactory since it is necessary to make modifications on a completely finished vehicle in order to provide for centering. These modifications in the plate will damage the anti-rust coatings or other protective coatings on the vehicle which in turn may lead to defects in the vehicle structure. Further, the play provided in the bolt holes does not produce a secure retaining of the guide element in which is formed the centering bore and under certain load conditions the plate with the centering bore may be shifted laterally when such lateral displacement is not at all desirable.

It is therefore the principal object of the present invention to provide a device for centering a brake magnet which is simple in structure, inexpensive to manufacture and provides for a reliable centering of the magnet when the magnet is raise from its working to its inoperative position.

It is another object of the present invention to provide such a centering device which is readily adjustable to provide for precise centering but which is not susceptible to accidental displacement because of loads.

It is a further object of the present invention to provide such a centering device which may be installed after the construction of the vehicle has been completed and in which all of the components for adjustment are incorporated in the centering device itself.

According to one aspect of the present invention a device for centering a rail brake magnet in the raised inoperative position with respect to the vehicle structure from which it is suspended may comprise a centering element on either the vehicle structure or magnet provided with a centering bore having a conical surface around the bore. A centering pin is mounted on the other of the vehicle structure or magnet and is provided with a conical surface engageable with the centering bore conical surface. The pin has an eccentric portion with respect to the conical surfaces and this eccentric portion is adjustable rotatably received in an eccentric sleeve which in turn is rotatably adjustable within a bore formed either in the magnet or the vehicle structure. The eccentric sleeve is then secured in its adjusted position.

By a relatively simple rotation of the eccentric sleeve and centering pin the present invention enables one to obtain a precise centering of the cooperating conical surfaces on the centering pin and guide element. As a result, the magnet is securely retained in a fixed position which eliminates any undesirable displacement of the magnet as a result of loads and forces incurred during operation of the vehicle.

In a preferred embodiment of the invention, the centering device is provided on three corners of the rail brake magnet and on the fourth corner there is provided a resilient buffer which can be adjusted to the level to which the magnet is raised.

Figure 1B:
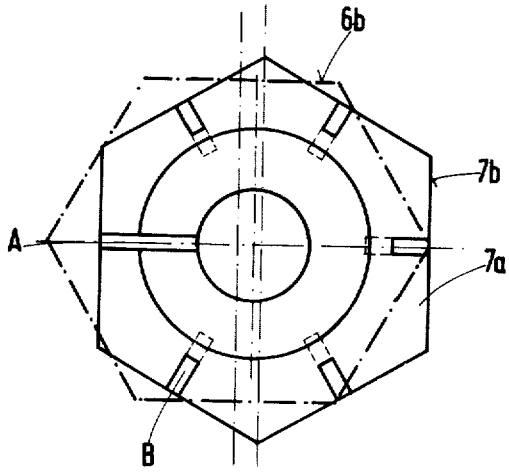
Figure 2:
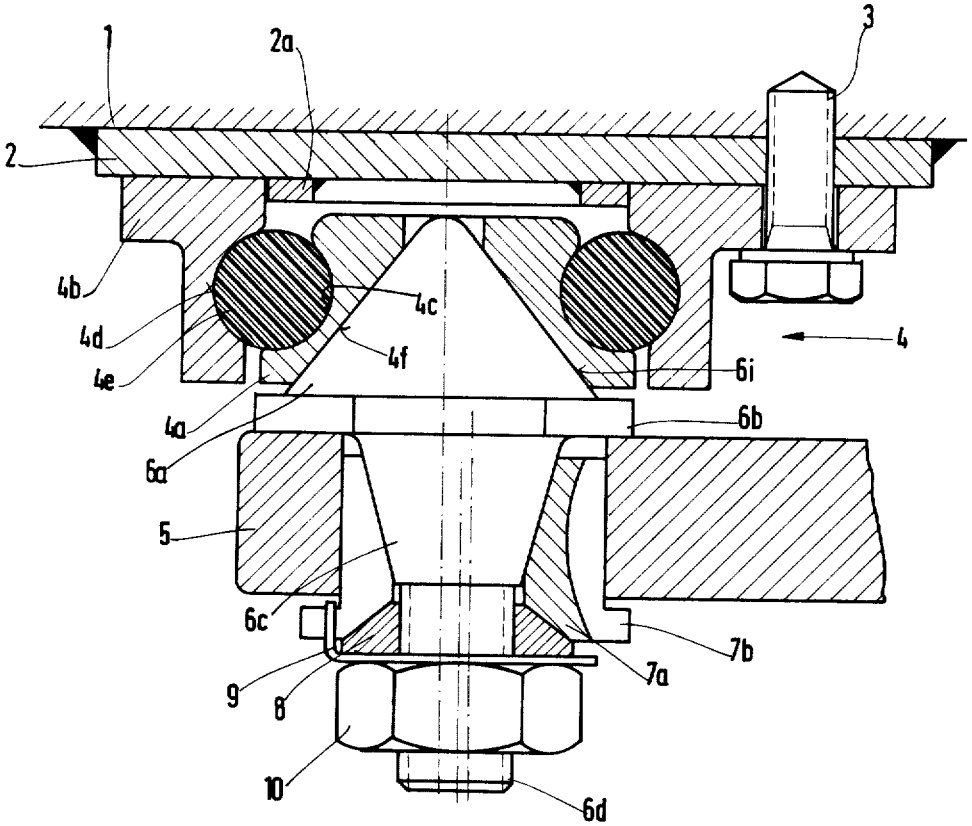
Figure 3:
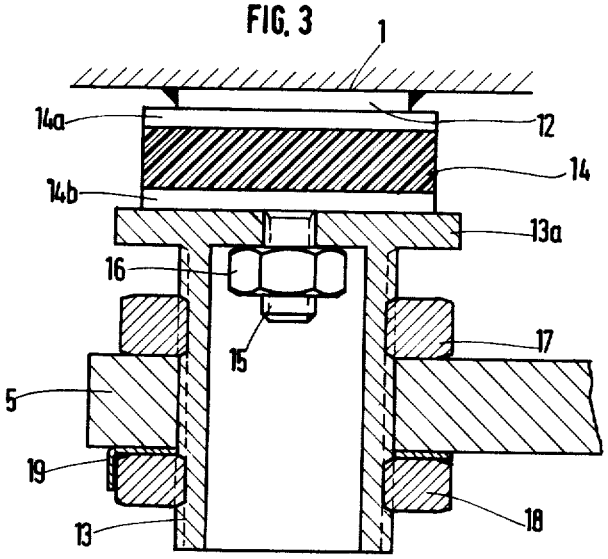

Other objects and advantages of the invention will be apparent upon reference to the accompanying description when taken in conjunction with the following drawings, which are exemplary, wherein;

FIG. 1*a* is a longitudinal sectional view of the centering device according to the present invention;

FIG. 1*b* is a bottom plan view of the centering device of FIG. 1*a*;

FIG. 2 is a view similar to that of FIG. 1*a* of a modification according to the present invention; and FIG. 3 shows a buffer which may be employed on the fourth corner of the rail brake magnet provided at its other three corners with the centering device of the present invention.

Proceeding next to the drawings wherein like reference symbols indicate the same parts throughout the various views a specific embodiment and modification of the present invention will be described in detail.

A rail brake magnet to which the present invention relates is generally located between the wheels on a railway truck. When the brake magnet is lowered the entire length of the magnet is positioned against the rail and a braking effect is achieved upon energization of the magnet. The magnet is displaced vertically between its inoperative and working positions by known actuating devices such as compressed air actuated and spring-loaded cylinders as described in the German printed specification 1,903,315. These actuation devices are not illustrated nor described in further detail since they are known in the art and since the centering device of the present invention may be employed with various forms of such actuation devices.

As may be seen in FIG. 1*a*, a plate 2 is welded to a part 1 of the vehicle frame structure which for a railway vehicle would be the truck. A centering device indicated generally at 4 comprises a flanged cylindrical or cup member **4*b* whose inner surface is conical and which is retained by four screws 3 passing through openings in the flange of the cylindrical member. The inner diameter opening of the cylindrical cup 4*b* is received over a cylindrical boss 2*a* on the plate 2 which centers the centering device 4** and prevents lateral displacement of the centering device.

A ring **4*a* is mounted within the cup member 4*b* by means of a rubber O-ring 4*e* which is positioned between mating grooves 4*d* and 4*c* on the inner surface of the cup member 4*b* and the outer surface of the ring 4*a* respectively. While the O-ring 4*e* is preferably of rubber it may be of any other suitable flexible material which would resiliently secure the ring 4*a*. The ring 4*a* is thus resiliently maintained in position within the cylindrical member 4*b***.

Prior to the installation of the brake magnet on the truck of the vehicle an element indicated generally at 6 is mounted on a portion of the brake magnet 5. The element 6 comprises a centering conical portion **6*a* having a conical surface 6*i* and a pin portion 6*c* which is connected to the conical portion 6*a* by means of a flange 6*h* which rests on top of the magnet 5. The pin 6*c* has a conical shape and is received within a bore 5*a* formed in the brake magnet 5. The magnet 5** is then raised in a known manner by means of compressed air actuated cylinders into the centered position as described in detail in the German printed specification 1,903,315.

The flange **6*h* has its peripheral surface 6*b*** in the form of a hexagon as shown in FIG. 1*b*. The conical spherical portion **6*c* which is the lower end of the element 6 has its longitudinal central axis positioned eccentrically by a small amount such as 3 mm with respect to the axis of the centering cone 6*a*. An eccentric sleeve 7*a* is inserted from below into the bore 5*a* of magnet 5 and at its lower end the sleeve is provided with an external flange 7*c* also having an hexagonal peripheral surface 7*b***.

The bore of eccentric sleeve **7*a* comprises a double conical portion tapering outwardly toward both ends and comprising a conical surface 7*d* which conforms to the conical surface 6*c* and a lower conical surface 7*e*. The double conical surface 7*d*, 7*e* is thus displaced laterally a small distance with respect to the cylindrical outer periphery of the eccentric sleeve 7*a*** and the axis of this double conical surface is parallel to the axis of the outer peripheral portion of the sleeve.

The element 6 comprising the centering cone **6*a* is rotated by means of a wrench positioned on the hexagonal portion 6*b* until the eccentric sleeve 7*a* is completely received within bore 5*a* in the brake magnet 5 and is in contact with the pin conical surface 6*c*. A conical ring 8 having a conical surface 8*a* which mates with the conical surface 7*e* on eccentric sleeve 7*a* is then positioned over the lower threaded end portion 6*d* of the element 6 and is urged into abutting engagement with the eccentric sleeve by means of a locking plate 9 and a nut 10 which is threaded on the threaded extension 6*d***.

The eccentric sleeve **7*a* together with the centering cone 6*a* can be adjusted by means of a wrench or similar tool positioned on the hexagonal flange 7*b* until the conical portion 6*a* is fully and closely received against the conical surface 4*f* of the centering device 4. In some cases, the element 6 and the eccentric sleeve 7*a* must be rotated with respect to each other in order to obtain precise centering. When the nut 10 is tightened, the force exerted by the nut 10 against the conical ring 8 will clamp the pin conical portion 6*c* and eccentric sleeve 7*a* by the interaction of the sleeve conical surfaces 7*d*, 7*e* and ring conical surface 8*a*. The locking plate 9 is provided with a radially extending tag which is then bent in order to secure the screw coupling comprising the pin threaded extension 6*d* and nut 10**.

The hexagonal flange **7*b* of the eccentric sleeve 7*a*** is provided with a radial slit A as shown in FIG. 1*b* and the remaining five sides of this hexagonal flange are notched radially with incisions or notches B. The slit A and notches B are thus uniformly spaced around the periphery **7*b*. The radial slit A is located in that portion of the eccentric sleeve 7*a* which has the thinnest wall thickness and the notches B are so disposed so as to provide a non-slitted cross-section of identical size. The slit A and notches B provide for a uniform spreading of the eccentric sleeve 7*a* in the bore 5*a* around its periphery so that an automatic rotating of the eccentric sleeve 7*a* is prevented. The materials of the components of the centering device are selected so as to prevent rusting of those components which are resting upon or in contact with each other. The hexagonal outline 6*b* of the element 6** is indicated in FIG. 1 *b* by means of the dot-dash lines in a relatively rotated position.

In the element 6 the conical portion **6*a* is provided with a cylindrical axial extension 6*f* at the end of which is a conical end surface 6*q* rounded at its extreme end. The cylindrical extension 6*f* assures that the horizontal adjustment of the brake magnet remains unchanged during any brief lowering of the brake magnet 5 because of large vertical acceleration. In addition, the cylindrical guide surface 6*f*** will absorb horizontal stresses without transforming these stresses into vertical stresses.

If only a very small travel or stroke is available for centering, the centering cone 6*a* may be constructed without these cylindrical guide portions 6*f* as shown in FIG. 2. The engaging conical surfaces 6*i* and 4*f* would in this case transform horizontal stresses into vertical stresses. In order to eliminate vertical vibrations together with any centering defects of the magnet 5 which may result therefrom, it is desirable to exert continously an upwardly directed force on the magnet 5 when it is in its inoperative position. This force is produced by an actuation device which is not illustrated but is known in the art and which strongly urges together the mating conical surfaces 6*i* and 4*f*. The remaining structure of the modification of FIG. 2 corresponds to that of FIG. 1*a* and accordingly the same reference symbols are employed.

As mentioned previously, only three corners of the rail brake magnet 5 are equipped with a centering device of FIG. 1 or FIG. 2. The fourth corner is provided with a sliding attachment in the form of a resilient buffer, preferably of rubber, an embodiment of which is shown in FIG. 3. A planar sliding plate 12 is welded to the vehicle frame structure 1. The magnet 5 is provided with a threaded bore in which is inserted a tubular bolt 13 having an upper external flange 13*a*. A rubber buffer element 14 or a similar flexible structure is attached to the upper flange 13*a* and may be reinforced or protected through metal plates 14*a* and 14*b* on its upper and lower surfaces. The lower plate 14*b* is provided with a threaded extension 15 that projects through an opening in the end flange 13*a* and is secured to the flange by means of a nut 16. The tubular bolt 13 is secured with respect to the magnet 5 by means of a nut 17 positioned above the magnet 5 and below the magnet 5 there is provided a nut 18 and a locking or retaining washer 19.

In the installation and adjustment of the rubber buffer of FIG. 3, the buffer element 14 is first attached to the tubular bolt 13 by means of nut 16. The tubular bolt 13 is then threaded into the bore in magnet 5 at which time the nut 17 is threaded up to abutting relationship against flange 13*a*. The various adjustments are then made on the remaining three corners of the magnet by means of the centering devices described above in connection with FIGS. 1 and 2. Subsequently, the buffer 14 is adjusted. The flange 13*a* of the tubular bolt 13 is held securely by a suitable tool applied to the peripheral edge of flange 13*a* which is in the shape of a hexagon and the nut 17 is threaded downwardly until the upper plate 14*a* contacts the sliding plate 12. Possible differences in adjustment caused by a twisting or bending of the frame of the vehicle or the truck would be compensated for in this manner. Finally, the nut 18 is tightened on the tubular bolt 13 and the tab on the locking washer 19 bent to secure the buffer 14 on the brake magnet 5.

It is therefore apparent that the present invention has provided a simple yet reliable centering device for a rail brake magnet wherein at least one of the two parts in abutting relationship and having engaging conical surfaces is provided with a pin located eccentrically with respect to these conical surfaces. The pin is adjustable with respect to its relative rotation and is secured in the bore of an eccentric sleeve and the eccentric sleeve is also adjustable with respect to its relative rotation about an axis eccentric to the bore of the sleeve. The pin is attached to either the rail brake magnet or to the vehicle structure.

It will be understood that this invention is susceptible to modification in order to adapt it to different usages and conditions, and accordingly, it is desired to comprehend such modifications within this invention as may fall within the scope of appended claims.

What is claimed is:

1. A device for centering a rail brake magnet in the raised inoperative position with respect to the vehicle structure from which it is suspended, and comprising a centering element on one of said vehicle structure and magnet having a centering bore with a first conical surface around said bore, the other of said vehicle structure and magnet having a bore therein and an eccentric sleeve rotatably received within said bore, a centering pin having a second conical surface thereon engageable with said first conical surface when the magnet is in the raised position, said pin having a peripheral portion eccentric with respect to said first and second conical surfaces and rotatably received within said eccentric sleeve, and means for securing said eccentric sleeve to said other of the vehicle structure and magnet after adjustably rotating said sleeve.

2. A device as claimed in claim 1 wherein said pin peripheral portion is conical, and screw coupling means having a corresponding conical surface for securing said pin within said eccentric sleeve.

3. A device as claimed in claim 2 wherein said eccentric sleeve has third and fourth conical surfaces thereon, a ring having a fifth conical surface threaded upon the free end of said pin against the outer of said third and fourth conical surfaces of said eccentric sleeve.

4. A device as claimed in claim 3 wherein said eccentric sleeve has an external flange on its end toward said ring.

5. A device as claimed in claim 1 wherein said centering element is mounted on said vehicle structure and said centering pin is mounted on said magnet.

6. A device as claimed in claim 5 wherein said centering element comprises a flanged cylindrical member rigidly attached by its flange to the vehicle structure, a second ring resiliently mounted within said cylindrical member to define said centering bore, said first conical surface being on said second ring.

7. A device as claimed in claim 6 and a plate attached to said vehicle structure and having a centering boss receiving said cylindrical member.

8. A device as claimed in claim 1 wherein said eccentric sleeve has a radial slit therein and a plurality of radial notches uniformly spaced about the periphery thereof.

9. A device as claimed in claim 8 wherein said radial notches are in the thicker wall portions than said radial slit.

10. A device as claimed in claim 1 wherein said centering pin has an external flange between its said second conical surface and its said eccentric peripheral portion, said flange resting upon said magnet.

11. A device as claimed in claim 1 wherein said centering pin has an axial projection from its said second conical surface, the outer end of said axial projection being conical.

12. A device as claimed in claim 1 and a plurality of means between said vehicle structure and said magnet arranged in four positions in the shape of a rectangle for limiting the movement of the magnet into its raised inoperative position, three of said means comprising said centering element and said centering pin, the fourth means comprising planar resilient means for buffering movement of said magnet toward the vehicle structure.

* * * * *